US007592750B2

(12) United States Patent
Lin et al.

(10) Patent No.: US 7,592,750 B2
(45) Date of Patent: Sep. 22, 2009

(54) FLUORESCENT LAMP WITH EXTERNAL ELECTRODES

(75) Inventors: Yu-Chuan Lin, Hunei Township, Kaohsing County (TW); Kuo-Chih Lee, Sinhua Township, Tainan County (TW)

(73) Assignee: AU Optronics Corporation, Hsinchu (TW)

( * ) Notice: Subject to any disclaimer, the term of this patent is extended or adjusted under 35 U.S.C. 154(b) by 475 days.

(21) Appl. No.: 11/342,306

(22) Filed: Jan. 27, 2006

(65) Prior Publication Data

US 2007/0176559 A1 Aug. 2, 2007

(51) Int. Cl.

| | |
|---|---|
| ***H01J 65/00*** | (2006.01) |
| ***F21V 7/04*** | (2006.01) |
| *F21S 4/00* | (2006.01) |
| *F21V 15/00* | (2006.01) |

(52) U.S. Cl. ..... 313/607; 313/631; 313/613; 362/224; 362/225; 315/291

(58) Field of Classification Search ..... 313/234, 313/237, 607, 623

See application file for complete search history.

(56) References Cited

U.S. PATENT DOCUMENTS

| | | | | |
|---|---|---|---|---|
| 6,674,250 | B2 | 1/2004 | Cho et al. | |
| 6,836,063 | B2 * | 12/2004 | Ishimoto et al. | 313/484 |
| 7,246,934 | B2 | 7/2007 | Jeong | 362/632 |
| 2002/0021564 | A1 | 2/2002 | Cho et al. | 362/97 |
| 2003/0231512 | A1 * | 12/2003 | Bang et al. | 362/560 |

FOREIGN PATENT DOCUMENTS

| | | |
|---|---|---|
| CN | 1632674 (A) | 6/2005 |
| JP | 2004179059 | 6/2004 |
| JP | 2005327560 A * | 11/2005 |

OTHER PUBLICATIONS

Takubo et al., Japanese Patent application 2005-327560, Nov. 2005, machine translation.*

* cited by examiner

*Primary Examiner*—Sikha Roy
*Assistant Examiner*—Tracie Green
(74) *Attorney, Agent, or Firm*—Ware, Fressola, Van Der Sluys & Adolphson, LLP

(57) ABSTRACT

An external-electrode fluorescent lamp has two external electrodes disposed on its ends, wherein each external electrode has an extended portion flattened to form two substantially flat circumferential areas. With such flattened circumferential areas, the electric contact made to the conductive strip can be improved. For mounting a row of external-electrode fluorescent lamps, a mounting base with two electrically conductive strips are used. Each electrically conductive strip has a plurality of curved sections to fit the extended portion of the external electrode. The curved section has two substantially sidewalls to make contact with the flat circumferential areas of the extended portion of the external electrode. The extended portion can also be slightly tapered.

11 Claims, 6 Drawing Sheets

FLUORESCENT LAMP WITH EXTERNAL ELECTRODES

FIELD OF THE INVENTION

The present invention relates generally to a tube-type fluorescent lamp and, more particularly, to a back-lighting panel having a plurality of such fluorescent lamps.

BACKGROUND OF THE INVENTION

In a transmissive or transflective liquid-crystal display panel, a back-lighting source is used behind the display panel to provide illumination. The back-lighting source can be a panel having an array of tube-type fluorescent lamps arranged in parallel, as shown in FIG. 1. As shown in FIG. 1, the back-lighting panel 1 has a plurality of external-electrode fluorescent lamps (EEFLs) 10 mounted between a pair of upper supports 30 and a pair of lower supports 20 mounted on a base plate 18. As can be seen from FIG. 2, each of the EEFLs 10 is a tube-type fluorescent lamp 12 having two external electrodes 14 at its ends. As shown in FIG. 2, the fluorescent tube 12 and the external electrodes 14 are cylindrical.

In order to supply electrical power to the lamps, each of the lower supports 20 has an electrically conductive strip 26 to be made contact with the external electrode 14. For example, the lower support 20 can have a supporting base 22 with a row of seats 23 to accommodate a plurality of cushions 24 so as to allow a strip 26 of electrically conductive material to be mounted on the supporting base 22. The conductive strip 26 has a plurality of curved sections 28 for placing the EEFLs. Each of the curved sections 28 has a curvature to accommodate the cylindrical external electrodes 14. The upper support 30 can be similar to the lower support 20 with or without the conductive strip 26. Two upper supports 30 and two lower supports 20 can be used to clamp down on a row of EEFLs as illustrated in FIG. 1.

Alternatively, a simpler mounting base can be used for mounting the EEFLs. As illustrated in FIG. 4*a*, a mounting base 40 has a supporting base 42 with a row of seats 44 so as to allow a conductive strip 46 to be mounted thereon. The conductive strip 46 has a plurality of curved sections 48 for placing the EEFLs 10. The curved section 48 is a V-shaped trough to allow an external electrode 14 to make electrical contact at two points on opposite sides of the trough as shown in FIG. 4*b*. A straight strip of material 50 can be used to hold down the EEFLs 10 seated in the curved sections 48.

Due to the shapes of the curved sections 28, 48 of the conductive strips 26, 46 and the cylindrical shape of the external electrode 14, the electrical contact between the EEFLs 10 and the supporting base 42 may not be satisfactory.

It is thus desirable and advantageous to provide an external-electrode fluorescent lamp and a matching mounting base with improved electrical contacts.

SUMMARY OF THE INVENTION

The external-electrode fluorescent lamp, according to the present invention, has two external electrodes disposed on its ends. The external electrode has an extended portion which is flattened to form two substantially flat circumferential areas. With such flat circumferential areas, the electric contact made to the conductive strip can be improved. For mounting a row of external-electrode fluorescent lamps, a mounting base with two electrically conductive strips are used. Each electrically conductive strip has a plurality of curved sections to fit the extended portion of the external electrode. The curved section has two substantially sidewalls to make contact with the flat circumferential areas of the extended portion of the external electrode. It is possible that the width of the curved section is slightly smaller than the width of the extended portion of the external electrode so that the curved section is slightly expanded when the external electrode is inserted into it. As such a tight fit between an external electrode and the mounting base can be achieved.

The present invention will become apparent upon reading the description taken in conjunction with FIGS. 5*a* to 10.

BRIEF DESCRIPTION OF THE INVENTION

Figure 4A:
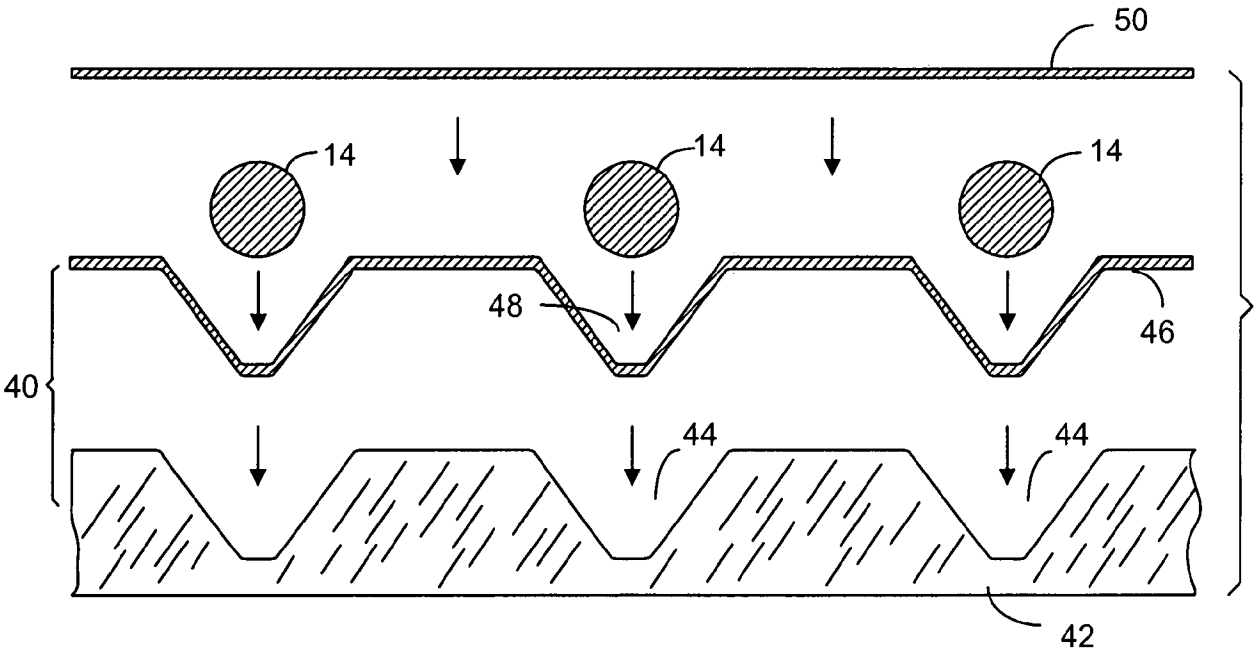
FIG. 4a (prior art)

FIG. 4*a* is an exploded view of a different prior art mounting support, including a plurality of prior art external-electrode fluorescent lamps.

Figure 4B:
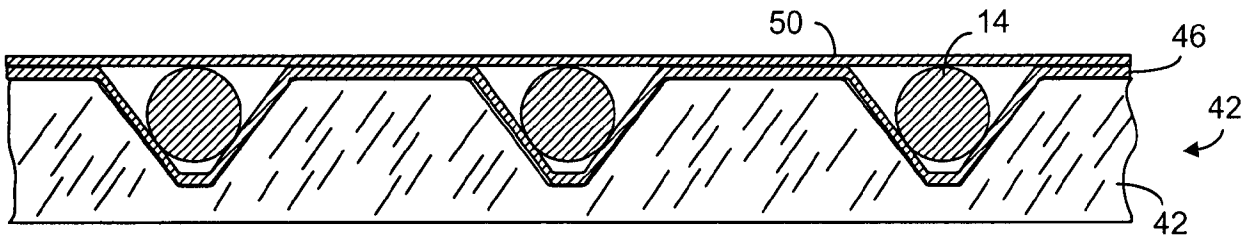
FIG. 4b (prior art)

FIG. 4*b* shows a cross sectional view of a prior art back-lighting panel having a mounting support as shown in FIG. 4*a*.

Figure 5B:
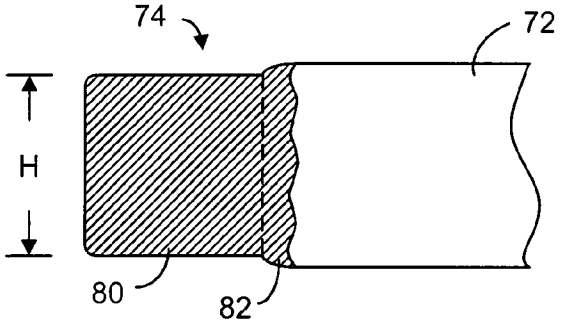
Figure 5C:
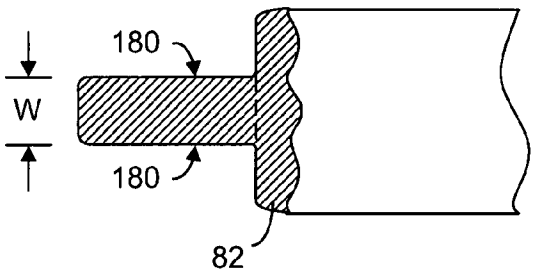
Figure 5A:
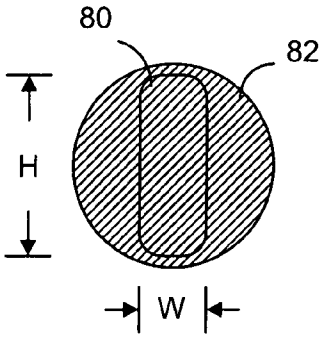

FIG. 5*a* is a front view of the external electrode fluorescent lamp, according to the present invention.

FIG. 5*b* shows a side view of the external-electrode fluorescent lamp, according to present invention.

FIG. 5*c* shows a different side view of the external-electrode fluorescent lamp, according to present invention.

Figure 6A:
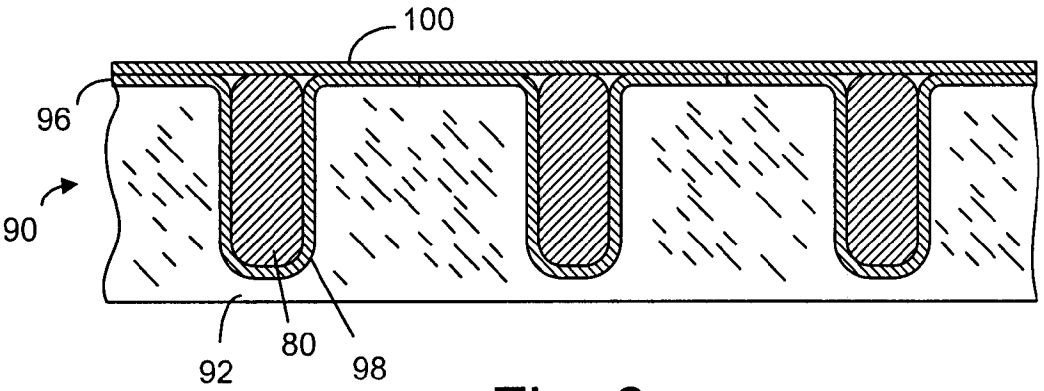

FIG. 6*a* is a schematic representation of the mounting support with a plurality of external electrodes, according to the present invention.

Figure 6B:
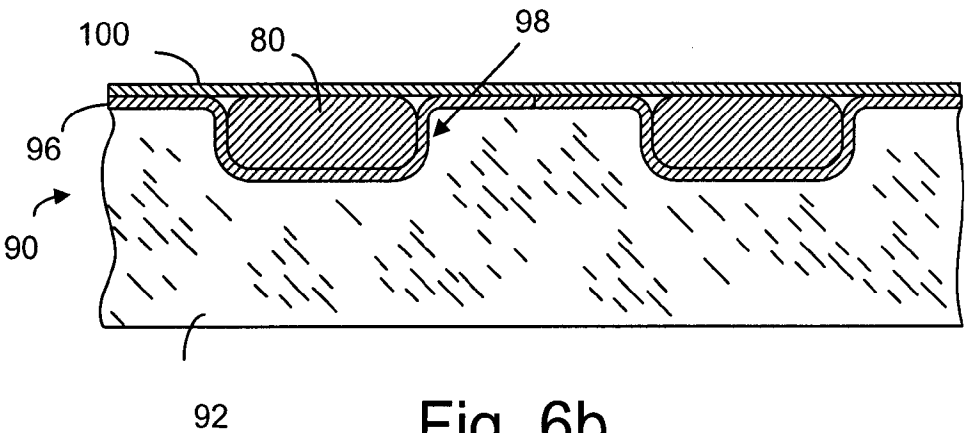

FIG. 6*b* is a schematic representation of the mounting support with a plurality of external electrodes, according to another embodiment of the present invention.

Figure 7C:
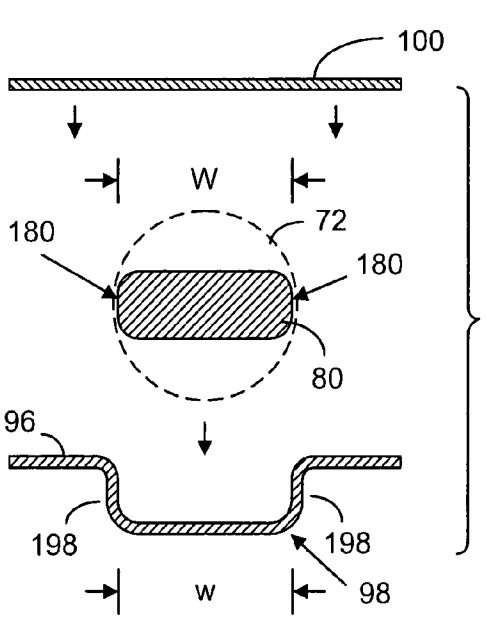
Figure 7D:
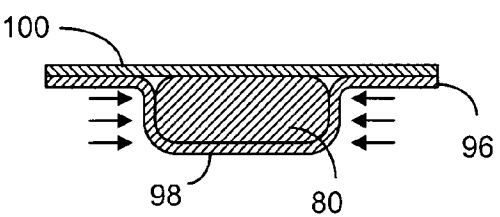
Figure 7A:
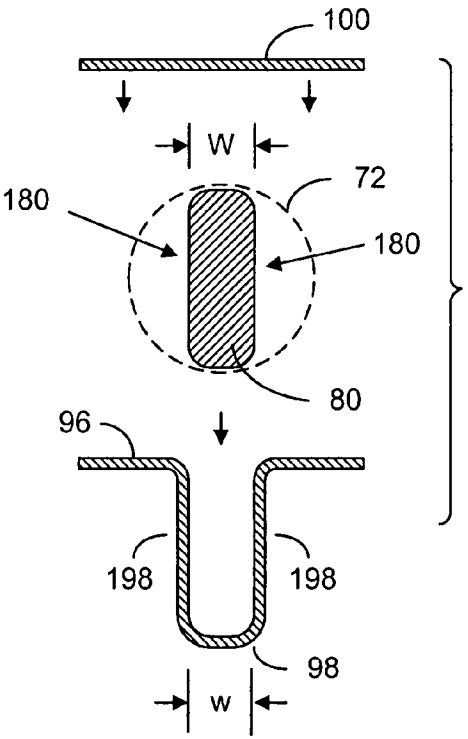

FIG. 7*a* is an exploded view showing the relationship between the extended portion of the external electrode and the curved section of the conductive strip as shown in FIG. 6*a*.

Figure 7B:
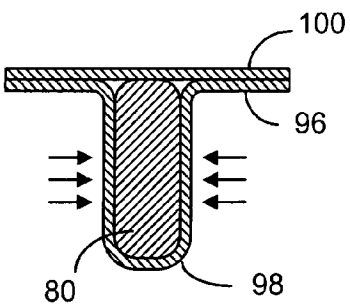

FIG. 7*b* shows how a tight fit between the curved section and the external electrode according to FIG. 7*a*.

FIG. 7*c* is an exploded view showing the relationship between the extended portion of the external electrode and the curved section of the conductive strip as shown in FIG. 6*b*.

FIG. 7*d* shows how a tight fit between the curved section and the external electrode according to FIG. 7*c*.

Figure 8:
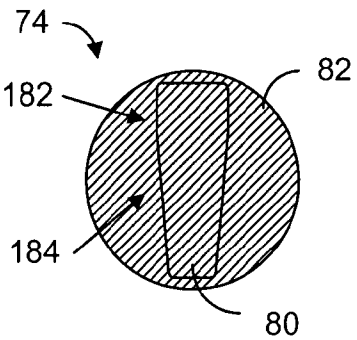

FIG. 8 shows the cross sectional view of the external electrode, according to another embodiment of the present invention.

Figure 9A:
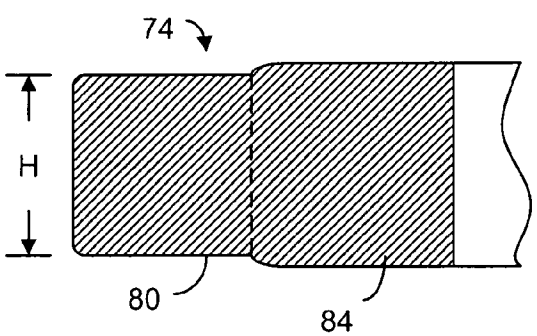

FIG. 9*a* shows a side view of an external-electrode fluorescent lamp having a different external electrode, according to present invention.

Figure 9B:
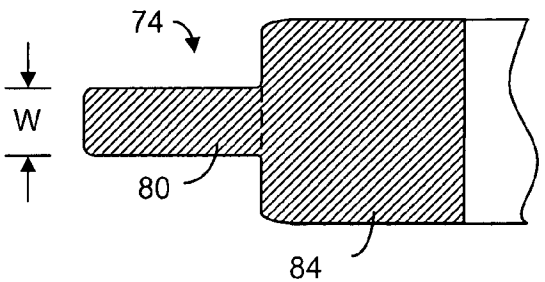

FIG. 9*b* shows a different side view of the external-electrode fluorescent lamp as shown in FIG. 9*a*.

Figure 10:
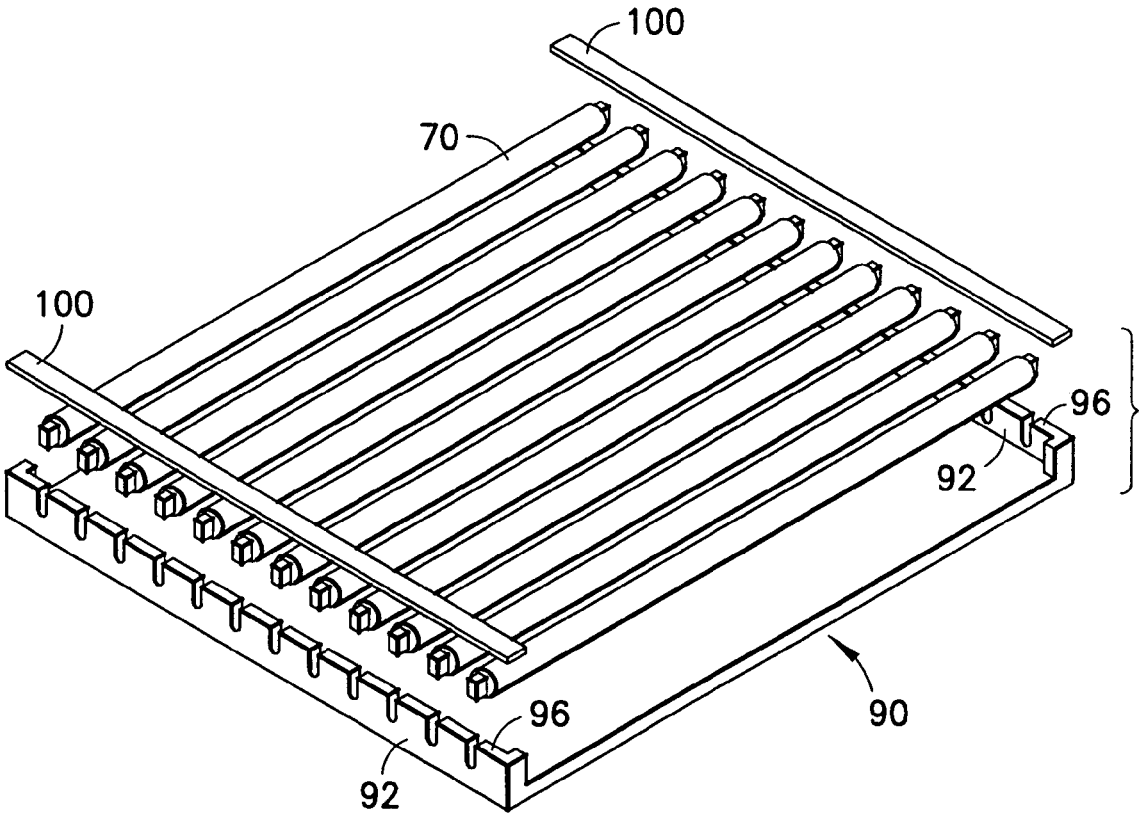

FIG. 10 shows a typical mounting panel for mounting a plurality of external-electrode fluorescent lamps, according to the present invention.

DETAILED DESCRIPTION OF THE INVENTION

Figure 1:
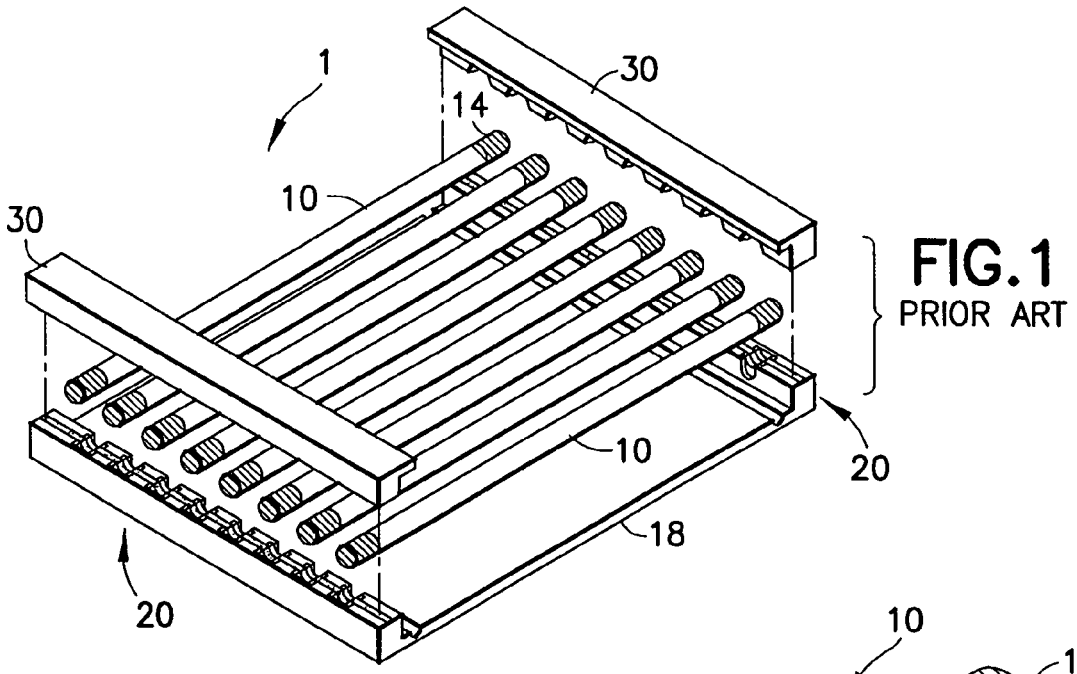
FIG.1 PRIOR ART
FIG. 1 shows a prior art back-lighting panel.
Figure 2:
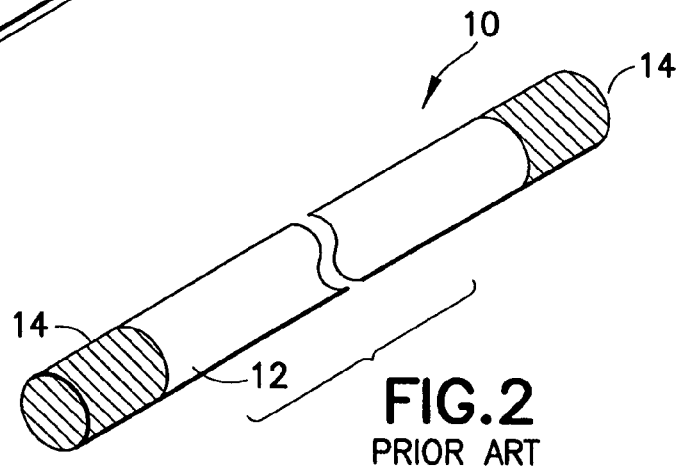
FIG.2 PRIOR ART
FIG. 2 shows a prior art external-electrode fluorescent lamp.
Figure 3:
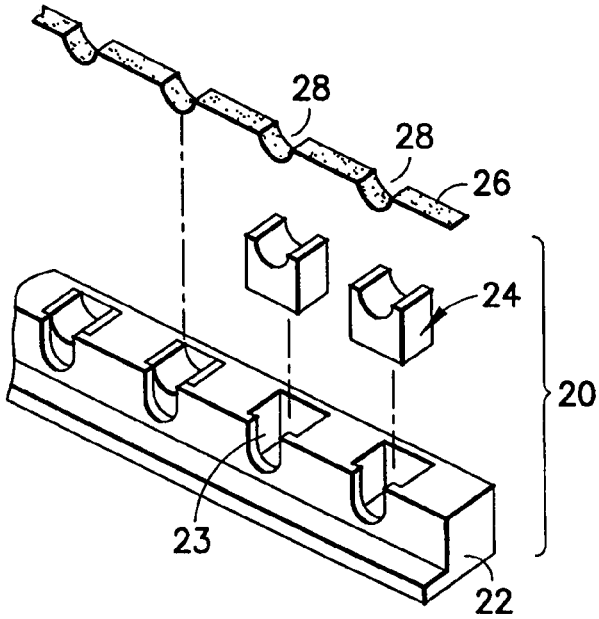
FIG.3 PRIOR ART
FIG. 3 is an exploded view of a prior art mounting support.

In the prior art external-electrode fluorescent lamp (EEFL) 10 as shown in FIG. 2, the external electrode 14 is essentially conformal to the end of the fluorescent tube 12. Thus, the cross section of the external electrode 14 has the same shape as the cross section of the fluorescent tube 10.

In the EEFL, according to the present invention, the cross section of the external electrode of the EEFL is different from that of the fluorescent tube. As shown in FIGS. 5*a* to 5*c*, the EEFL 70 has a cylindrical fluorescent tube 72 and an external electrode 74 on each of the tube's ends. While the cross section of the fluorescent tube 72 is substantially round, the cross section of the external electrode 74 is different. The external electrode 74 has an electrically conductive sleeve 82 formed on the fluorescent tube 72, and extended portion 80 connected to the sleeve 82. While the sleeve 82 is substantially conformal to the tube's end, the extended portion 80 is not. As shown in FIGS. 5*a* to 5*c*, the extended portion 80 is flattened on two sides so that the circumferential surface of the extended portion 80 has two substantially flat areas 180. As such, the cross section of the extended portion is elongated such that the width, W, of the cross section is smaller than the height, H. The electrically conductive portions of the extended portion 80 and the sleeve 82 may be formed simultaneously in the same fabrication process. For example, the electrically conductive portions of the extended portion 80 and the sleeve 82 may be made of a metal or other electrically conductive materials formed by coating, sputtering, dipping or plating processes.

In order to provide electrical power to the EEFLs 70, a mounting base has an electrically conductive strip to make electrical contact to the extended portion 80 of the external electrodes. The mounting base 90 has two base supports 92 and two electrically conductive strips 96 for mounting a plurality of EEFLs 70. A schematic representation of the mounting base 90 is shown in FIG. 6*a*. As shown, each conductive strip 96 has a row of curved sections 98 shaped to fit the extended portion 80 of the external electrode 74. A straight strip 100 of a suitable material is used to secure the extended portion 80 of each EEFL 70 in a curved section 98 on each side of the mounting base 90. The strip 100 can be electrically conductive or non-conductive. An exploded view of a section of the strip-electrode assembly is shown in FIG. 7*a*. As shown, the curved section 98 of the conductive strip 96 has two sidewalls 198 to make electrical contact to the flat circumferential areas 180 of the extended portion 80. Because the inner side-walls are flat and the shape of the curved section 98 is made conformal to the extended portion 80, the electrical contact is improved over the prior art. Furthermore, it is possible that the width, w, of the curved section 98 is slightly smaller than the width, W, of the extended portion 80. As such, when the extended portion is inserted into the curved section 98 of the conductive strip 96, the curved section 98 is slightly expanded. As a result, an inward urging force acting on the side-walls further improves the electrical contact between the side walls of the curved section and the flat areas of the extended portion 80, as illustrated in FIG. 7*b*.

It should be noted that the base support 92 and its conductive strips 96 can be shaped differently to mount the EEFLs 70 with the same external electrode 74. As shown in FIGS. 6*b*, 7*c* and 7*d*, the width w of the curved section 98 is made to fit the larger dimension of the extended portion 80.

The cross section of the extended portion 80 of the external electrode 74 can be different from that depicted in FIGS. 5*a* to 7*d*. For example, the flat areas of the extended portion 80 are not necessarily parallel to each other. In other words, the width of the extended portion 80 is not necessarily uniform throughout the height. For example, the extended portion 80 can have a constant width section 182 and a tapered section 184, as shown in FIG. 8. Nevertheless, the extended portion has flat circumferential areas to achieve good electric contact with a curved section of a matched shape.

Moreover, the sleeve portion of the external electrode can be short or long. For example, the external electrode 74 can have an extensive sleeve 84 covering a sufficient portion of the fluorescent tube, as shown in FIGS. 9*a* and 9*b*.

A typical mounting panel for mounting a plurality of external-electrode fluorescent lamps, according to the present invention, is shown in FIG. 10.

Although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A fluorescent lamp having a first end, an opposing second end and a tube body between the first and second ends, the tube body having a diameter at the first and second ends, said lamp comprising:

a first external electrode on the first end; and a second external electrode on the second end, wherein the first external electrode has a first section contacting the tube at the first end, and a second section extended from the first section away from the first end, and wherein the first section has an inner diameter substantially equal to the diameter of the tube at the first end, the second external electrode has a first section contacting the tube at the second end, and a second section extended from the first section away from the second end, and wherein the first section has an inner diameter substantially equal to the diameter of the tube at the second end, and the second section of the first external electrode has a first elongated cross section, wherein the first elongated cross section has a greater dimension and a smaller dimension, the first elongated cross section comprising two substantially straight segments defining the smaller dimension, and wherein the two substantially straight segments form an angle such that the first elongated cross section has a tapered shape.

2. The fluorescent lamp of claim 1, wherein the second section of the second external electrode has a second elongated cross section.

3. The fluorescent lamp of claim 1, wherein the first elongated cross section comprises two further substantially straight segments defining the greater dimension.

4. The fluorescent lamp of claim 2, wherein the second elongated cross section has a greater dimension and a smaller dimension.

5. The fluorescent lamp of claim 4, wherein the second elongated cross section comprises two substantially straight segments defining the smaller dimension.

6. The fluorescent lamp of claim 5, wherein the two substantially straight segments are substantially parallel to each other.

7. The fluorescent lamp of claim 5, wherein the two substantially straight segments form an angle such that the first elongated cross section has a tapered shape.

8. A panel for mounting a plurality of fluorescent lamps, at least some of the fluorescent lamps having a first end, an opposing second end and a tube body between the first and second ends, the tube body having a diameter at the first and second ends, each of said at least some lamps comprising:

an external electrode on each of the first and second ends, wherein the external electrode has a first section contacting the tube at the respective end, and a second section extended from the first section away from the respective end, and wherein the first section has an inner diameter substantially equal to the diameter of the tube at the ends, and wherein the second section of the external electrode has an elongated cross section, the elongated cross section has a smaller dimension and a greater dimension, said panel comprising:

a first electrically conductive strip, and a second electrically conductive strip, wherein the first strip has a row of curve sections, each curve section having two side walls dimensioned to fit the smaller dimension of the elongated cross section of the second section of the external electrode on the first end of one of said lamps, and the second strip has a row of curve sections, each curve section having two side walls dimensioned to fit the smaller dimension of the elongated cross section of the second section of the external electrode on the second end of one of said lamps, wherein each elongated cross section comprises two substantially straight segments defining the smaller dimension, and wherein the two substantially straight segments form an angle such that the first elongated cross section has a tapered shape.

9. The panel of claim 8, wherein each elongated cross section comprises two substantially straight segments defining the greater dimension.

10. A panel for mounting a plurality of fluorescent lamps, at least some of the fluorescent lamps having a first end, an opposing second end and a tube body between the first and second ends, the tube body having a diameter at the first and second ends, each of said at least some lamps comprising:

an external electrode on each of the first and second ends, wherein the external electrode has a first section contacting the tube at the respective end, and a second section extended from the first section away from the respective end, and wherein the first section has an inner diameter substantially equal to the diameter of the tube at the ends, and wherein the second section of the external electrode has an elongated cross section, the elongated cross section has a smaller dimension and a greater dimension, said panel comprising:

a first electrically conductive strip, a second electrically conductive strip, wherein the first strip has a row of curve sections, each curve section having two side walls dimensioned to fit the smaller dimension of the elongated cross section of the second section of the external electrode on the first end of one of said lamps, and the second strip has a row of curve sections, each curve section having two side walls dimensioned to fit the smaller dimension of the elongated cross section of the second section of the external electrode on the second end of one of said lamps, and two straight strips, each strip disposed on one of the electrically conductive strip for securing the second section of each external electrode fitted in one of the curved sections.

11. The panel of claim 10, wherein the strips are made of an electrically conductive material.

* * * * *

UNITED STATES PATENT AND TRADEMARK OFFICE

CERTIFICATE OF CORRECTION

PATENT NO. : 7,592,750 B2
APPLICATION NO. : 11/342306
DATED : September 22, 2009
INVENTOR(S) : Lin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 713 days.

Signed and Sealed this

Twenty-first Day of September, 2010

David J. Kappos

David J. Kappos
*Director of the United States Patent and Trademark Office*